US011846214B1

(12) United States Patent
Morinaga et al.

(10) Patent No.: US 11,846,214 B1
(45) Date of Patent: Dec. 19, 2023

(54) OIL CIRCULATOR APPARATUS

(71) Applicant: HONDA MOTOR CO., LTD., Tokyo (JP)

(72) Inventors: Ryota Morinaga, Wako (JP); Hideki Ikeda, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/955,672

(22) Filed: Sep. 29, 2022

(51) Int. Cl.

| | |
|---|---|
| ***F01M 11/02*** | (2006.01) |
| ***F01M 11/03*** | (2006.01) |
| ***F01M 1/16*** | (2006.01) |
| ***F01M 1/02*** | (2006.01) |

(52) U.S. Cl.
CPC ..... *F01M 11/02* (2013.01); *F01M 1/02* (2013.01); *F01M 1/16* (2013.01); *F01M 11/03* (2013.01)

(58) Field of Classification Search
CPC . F01M 11/02; F01M 1/02; F01M 1/16; F01M 11/03; B01D 35/153; B63H 20/32; B63H 20/002
See application file for complete search history.

(56) References Cited

U.S. PATENT DOCUMENTS

| | | | | |
|---|---|---|---|---|
| 4,151,823 A * | 5/1979 | Grosse | ..... | F01M 11/03 210/167.02 |
| 6,517,710 B2 * | 2/2003 | Hartmann | ..... | B01D 35/153 210/232 |
| 10,723,427 B1 * | 7/2020 | Egleston | ..... | B01D 29/15 |

FOREIGN PATENT DOCUMENTS

| | | | | |
|---|---|---|---|---|
| CA | 2695058 A1 * | 10/2010 | ..... | F01M 11/02 |
| JP | 2009-102993 | 5/2009 | | |
| JP | 2015-203326 | 11/2015 | | |

* cited by examiner

*Primary Examiner* — Syed O Hasan
(74) *Attorney, Agent, or Firm* — AMIN, TUROCY & WATSON, LLP

(57) ABSTRACT

An oil circulator apparatus (5) includes: a crankcase (7) in which a movable portion is stored; an oil flow path (15) that is provided on the crankcase (7) and guides oil to the movable portion; an oil pump that delivers the oil to the movable portion via the oil flow path (15); a main gallery (19) that is provided in a middle of the oil flow path (15) and is formed along an upward-downward direction; an oil filter (22) that is provided in a middle of the main gallery (19) and filters the oil which flows through the main gallery (19); and an oil discharge port (33) that is provided in the main gallery (19) at a further downstream side in a flow direction of the oil than the oil filter (22) and causes the main gallery (19) to be in communication with an inside of the crankcase (7).

7 Claims, 5 Drawing Sheets

OIL CIRCULATOR APPARATUS

BACKGROUND OF THE INVENTION

Field of the Invention

The present invention relates to an oil circulator apparatus.

Background Art

For example, an outboard engine includes an oil lubrication apparatus that circulates oil (lubrication oil) supplied to an engine in order to cool the engine (internal combustion engine). The oil lubrication apparatus includes an oil flow path that is formed along the outboard engine, an oil pump that delivers oil to the oil flow path, and an oil filter that is provided in the middle of the oil flow path. The oil flow path circulates the oil in the outboard engine and is in communication with the engine. The oil filter filters the oil supplied to the engine.

The oil pump is driven in response to the driving force of the engine. Therefore, the oil is circulated by the oil pump during driving of the engine. The engine is effectively cooled by the oil. The oil pump also stops when the engine stops. When the engine stops, since the temperature of the engine does not actively increase, it is not necessary to circulate the oil. The oil pump stops, and thereby, the oil remains in the oil flow path.

Due to the structure of the outboard engine, the oil flow path is formed such that the oil circulates in an upward-downward direction. Therefore, when the oil filter is replaced during stopping of the engine, there may be cases in which the oil that remains in the oil flow path at an upper position (the downstream side) than the oil filter overflows. In order to prevent such overflow of oil at the time of replacement of the oil filter, various techniques have been proposed.

For example, Patent Document 1 (Japanese Unexamined Patent Application, First Publication No. 2009-102993) discloses a technique in which an oil return flow path for causing the oil to return to an oil pan is provided on a lower portion of the oil flow path. According to this, the oil that is to overflow when replacing the oil filter is caused to return to the oil pan via the oil return flow path. Therefore, it is possible to prevent the oil from overflowing at the time of replacement of the oil filter.

Further, Patent Document 2 (Japanese Unexamined Patent Application, First Publication No. 2015-203326) discloses a technique in which a pan (a flange portion and longitudinal wall portion) which receives the oil that overflows when replacing the oil filter is provided.

SUMMARY OF THE INVENTION

However, in Patent Document 1 described above, it is necessary to provide an oil return flow path in a region between the oil flow path to the oil pan. Therefore, the occupation space of the oil flow path becomes large. Therefore, the lubrication apparatus may become large, and manufacturing costs of the lubrication apparatus may increase.

In Patent Document 2, it is not possible to prevent overflow of oil. Therefore, there is a problem that this may not be an effective solution at the time of replacement of the oil filter. There is a possibility that a renewable energy may be reduced due to the overflow of oil.

Accordingly, the present invention provides an oil circulator apparatus that can prevent the size of the apparatus from increasing and prevent the increase in manufacturing costs, can effectively prevent the overflow of oil at the time of replacement of an oil filter, and can contribute to the improvement of energy efficiency.

In order to solve the problem described above, the present invention proposes the following means.

(1) An oil circulator apparatus (for example, an oil circulator apparatus 5 of an embodiment) according to the present invention includes: a crankcase (for example, a crankcase 7 of the embodiment) in which a movable portion is stored; an oil flow path (for example, an oil flow path 15 of the embodiment) that is provided on the crankcase and guides oil to the movable portion; an oil pump (for example, an oil pump 16 of the embodiment) that delivers the oil to the movable portion via the oil flow path; a main gallery (for example, a main gallery 19 of the embodiment) that is provided in a middle of the oil flow path and is formed along an upward-downward direction; an oil filter (for example, an oil filter 22 and a filter main body 32 of the embodiment) that is provided in a middle of the main gallery and filters the oil which flows through the main gallery; and an oil discharge port (for example, an oil discharge port 33 of the embodiment) that is provided in the main gallery at a further downstream side in a flow direction of the oil than the oil filter and causes the main gallery to be in communication with an inside of the crankcase.

In this way, a structure is employed which causes the oil to return from the main gallery into the crankcase. In order to cause the oil to return from the main gallery into the crankcase, it is sufficient only to provide the oil discharge port. Therefore, since it is not necessary to ensure an additional space and the structure is also simple, the oil circulator apparatus can be downsized, and it is possible to prevent the increase in manufacturing costs. It is possible to effectively prevent the overflow of oil at the time of replacement of the oil filter, and it is possible to contribute to the improvement of energy efficiency.

(2) The configuration described above may include: an oil filter base (for example, an oil filter base 21 of the embodiment) which is provided in a middle of the main gallery and to which the oil filter is attached; and an oil discharge flow path (for example, a discharge flow path 34, an upper introduction path 36, a lower introduction path 37, a return flow path 38, and a discharge flow path main body 39 of the embodiment) that is formed on the oil filter base and causes the downstream side of the oil filter to be in communication with the oil discharge port.

According to such a configuration, processing to the crankcase side can be reduced as much as possible. It is sufficient to process the oil filter base in order to prevent the overflow of oil at the time of replacement of the oil filter. Therefore, the processing for causing the oil to return from the main gallery into the crankcase can be facilitated. Accordingly, it is possible to prevent the increase in manufacturing costs of the oil circulator apparatus.

(3) The configuration described above may include an orifice (for example, an orifice 40 of the embodiment) that is provided on the oil discharge flow path and has a flow path cross-sectional area which is smaller than a flow path cross-sectional area of the oil discharge flow path.

According to such a configuration, it is possible to prevent the oil from returning from the oil discharge port into the crankcase via the oil discharge flow path in vain at the time of driving of the movable portion. Therefore, it is possible to contribute to the improvement of energy efficiency.

(4) In the configuration described above, the oil discharge flow path may include a return flow path (for example, a return flow path 38 of the embodiment) that is connected to the oil discharge port, and the return flow path may be formed in a downward gradient toward the oil discharge port.

According to such a configuration, the oil does not remain in the oil discharge flow path, and it is possible to cause the oil to quickly return into the crankcase.

(5) The configuration described above may include a stopper (for example, a stopper main body 42 of the embodiment) that is provided on the oil discharge flow path and permits and blocks a flow of the oil from the main gallery to the oil discharge port via the oil discharge flow path.

According to such a configuration, by the stopper, it is possible to further reliably prevent the oil from returning from the oil discharge port into the crankcase via the oil discharge flow path in vain at the time of driving of the movable portion. Therefore, it is possible to further contribute to the improvement of energy efficiency.

(6) The configuration described above may include: a first communication path (for example, a lower introduction path 37 of the embodiment) and a second communication path (for example, an upper introduction path 36 of the embodiment) that cause the oil discharge flow path to be in communication with the main gallery; and an orifice (for example, an orifice 40 of the embodiment) that is provided on the first communication path and has a flow path cross-sectional area which is smaller than a flow path cross-sectional area of the first communication path, wherein the stopper may be arranged between the first communication path and the second communication path and be arranged such that the first communication path and the oil discharge port are capable of being closed simultaneously, and an elastic member (for example, a coil spring 43 of the embodiment) that is provided on the oil discharge flow path and elastically biases the stopper from the first communication path and the oil discharge port toward the second communication path may be provided.

According to such a configuration, the stopper can reliably function with a simple structure. By the stopper, it is possible to reliably prevent the oil from returning from the oil discharge port into the crankcase via the oil discharge flow path in vain at the time of driving of the movable portion. Therefore, it is possible to contribute to the improvement of energy efficiency.

(7) In the configuration described above, the oil filter may be provided so as to protrude obliquely upward relative to the main gallery, and an oil reception flange (for example, an oil reception flange 28 of the embodiment) that covers a lower portion of the oil filter may be provided.

According to such a configuration, even if oil leaks at the time of replacement of the oil filter, it is possible to receive oil by the oil reception flange.

Effects of the Invention

According to the present invention, it is possible to prevent the size of the oil circulator apparatus from increasing and prevent the increase in manufacturing costs. Further, it is possible to effectively prevent the overflow of oil at the time of replacement of the oil filter, and it is possible to contribute to the improvement of energy efficiency.

EMBODIMENTS

Next, an embodiment of the present invention will be described with reference to the drawings.

<Outboard Engine>

Figure 1:
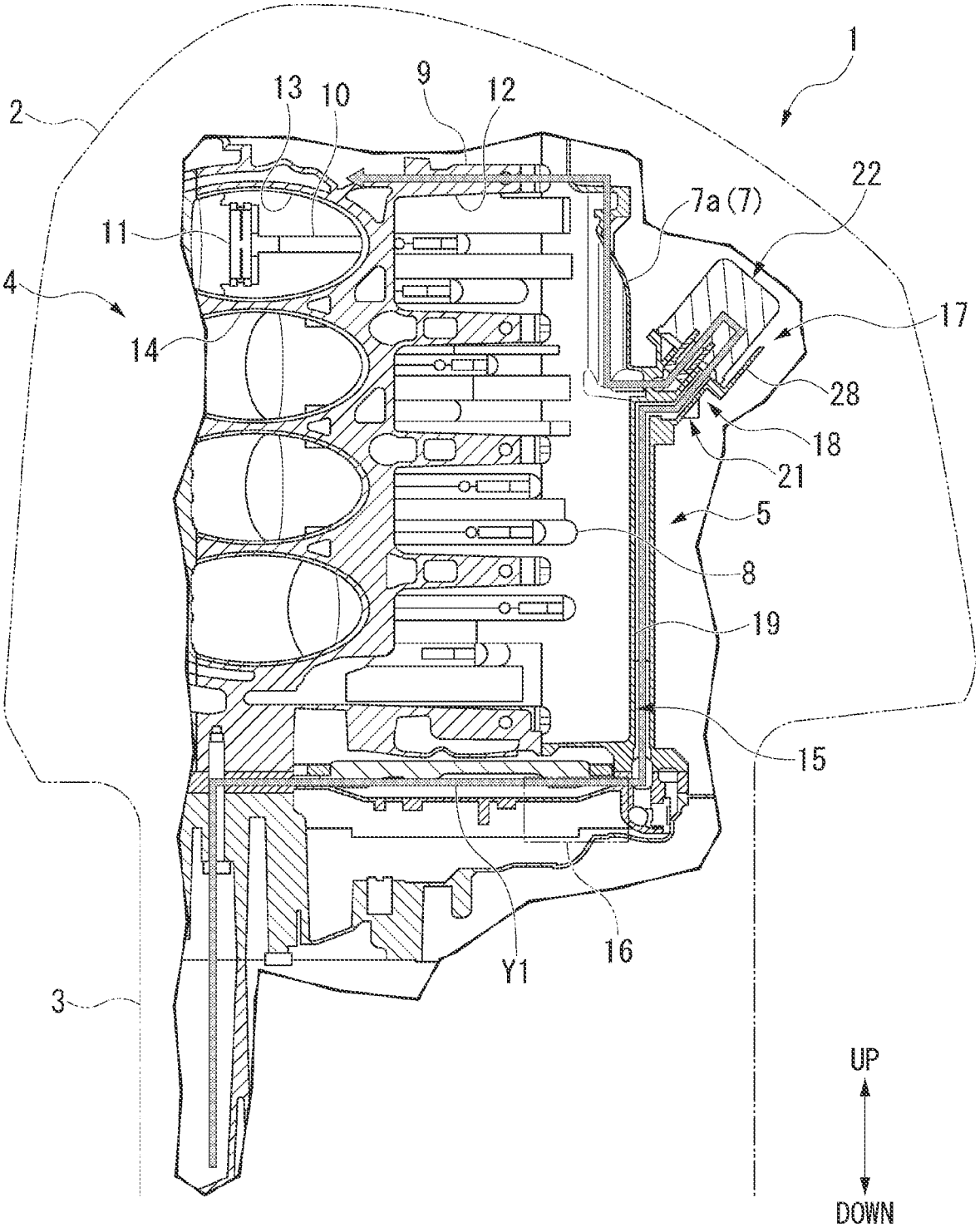
FIG. 1 is a schematic configuration view of a main part of an outboard engine according to an embodiment of the present invention.

FIG. 1 is a schematic configuration view of a main part of an outboard engine 1. As shown in FIG. 1, the outboard engine 1 that is provided on a hull (not shown) includes an engine 4 and an oil circulator apparatus 5 that cools and lubricates the engine 4 in a top cowl 2 that forms an outer shell and a casing 3 that is provided at a lower portion of the top cowl 2. The following description refers to an upward-downward direction and a horizontal direction in a state where the outboard engine 1 is arranged at a tilt-down position. The tilt-down position refers to a position where the outboard engine 1 is in a fully lowered state. In other words, the tilt-down position refers to the position of the outboard engine 1 when the hull is driven at a position where the outboard engine 1 is almost perpendicular to the water surface.

<Engine>

The engine 4 includes a crankcase 7 and a movable portion 8 that is provided in the crankcase 7. The movable portion 8 includes a cylinder block 9, a crankshaft (not shown) that is rotatably supported by the crankcase 7 and the cylinder block 9, a piston 11 that is connected to the crankshaft via a con rod 10, and the like.

A crank chamber 12 and a cylinder 13 are formed on a cylinder block 9. The crank chamber 12 is formed so as to extend in the upward-downward direction. The crankshaft extends in the upward-downward direction and is stored in the crankcase 12. The cylinder 13 is formed so as to extend in the horizontal direction. The piston 11 is slidably stored in the cylinder 13. The piston 11 is stored in the cylinder 13, and thereby, a combustion chamber 14 is formed.

<Oil Circulator Apparatus>

The oil circulator apparatus 5 includes an oil flow path 15 that is provided on the crankcase 7, an oil pump 16 that is connected to the oil flow path 15, an oil filter unit 17 that is provided in the middle of the oil flow path 15, and an oil return mechanism 18 that is provided on the oil filter unit 17.

The oil flow path 15 is formed such that oil (not shown) is circulated over the entire upward-downward direction of the oil flow path 15. The oil flow path 15 guides the oil to the movable portion 8 from a portion that is submerged in the water of the outboard engine 1. A main gallery 19 that extends in the upward-downward direction along a wall surface 7*a* of the crankcase 7 is formed on part of the oil flow path 15.

The oil pump 16 is driven via the crankshaft. The oil pump 16 pumps up the oil accumulated in the oil flow path 15 upward. Then, the oil pump 16 delivers the oil to the movable portion 8 in the crankcase 7 (refer to an arrow Y1 in FIG. 1).

The following description may refer to an upstream side and a downstream side relative a flow direction of the oil.

<Oil Filter Unit>

Figure 2:
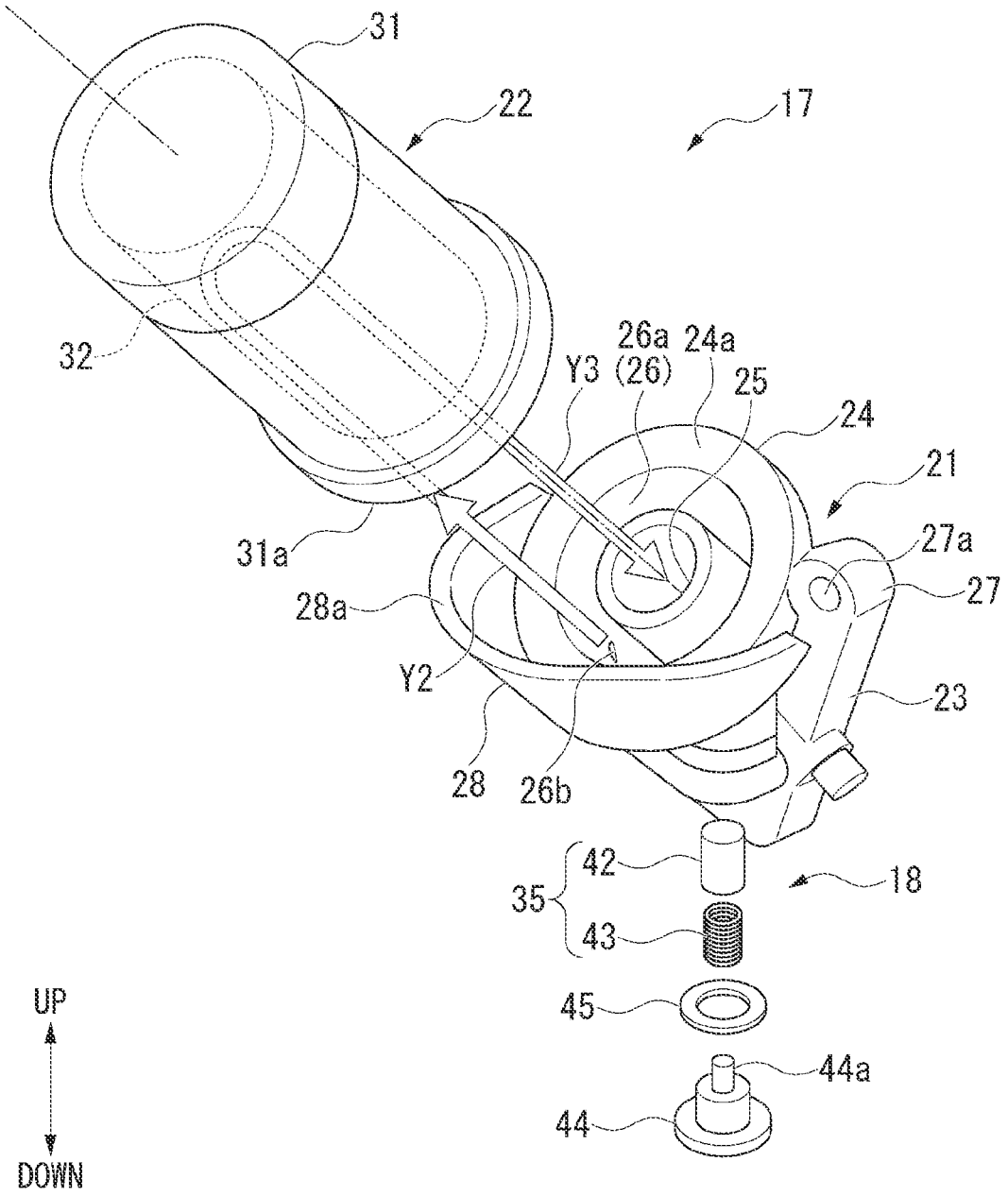
FIG. 2 is an exploded perspective view of an oil filter unit according to the embodiment of the present invention.
Figure 3:
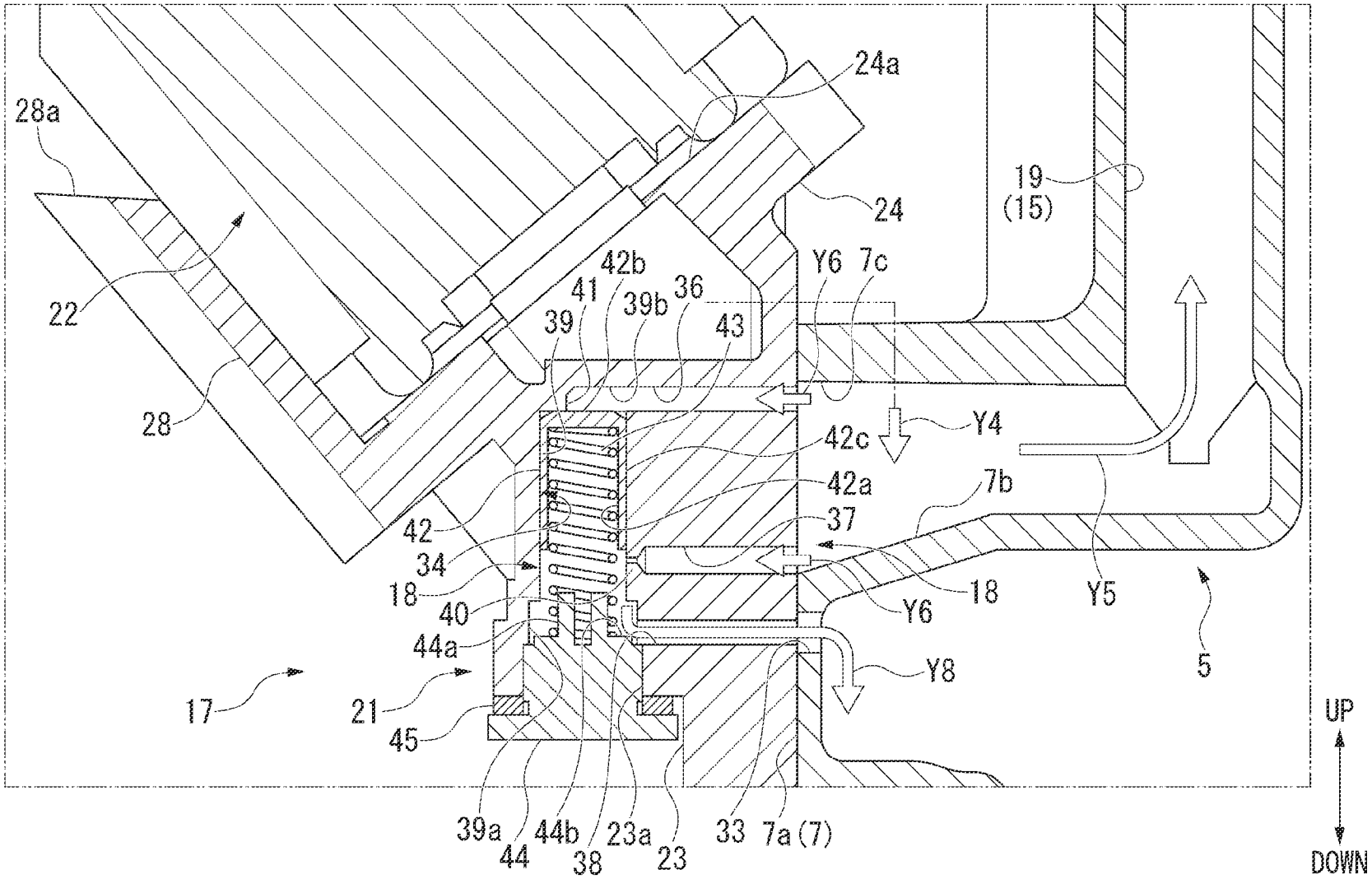
FIG. 3 is a cross-sectional view along an upward-downward direction in the vicinity of the oil filter unit according to the embodiment of the present invention.

FIG. 2 is an exploded perspective view of an oil filter unit 17. FIG. 3 is a cross-sectional view along the upward-downward direction in the vicinity of the oil filter unit 17. In FIG. 3, FIG. 1 is seen from an opposite side of the plane of paper.

The oil filter unit 17 filters the oil that is delivered to the movable portion 8 of the engine 4 in the middle of the oil flow path 15.

As shown in FIG. 1 to FIG. 3, the oil filter unit 17 is provided in the middle of the main gallery 19. An opening flow path 7*b* that is in communication with the main gallery 19 is formed on the wall surface 7*a* of the crankcase 7 that corresponds to the middle of the main gallery 19. The oil filter unit 17 is provided so as to close the opening flow path 7*b* from the outside. The opening flow path 7*b* is formed so as to extend in the horizontal direction. The opening flow path 7*b* forms an opening portion 7*c* on the wall surface 7*a* of the crankcase 7. The opening flow path 7*b* is located at a downstream side of the oil filter unit 17.

The oil filter unit 17 includes an oil filter base 21 that is attached so as to close the opening flow path 7*b* of the crankcase 7, an oil filter 22 that is supported by the oil filter base 21, and the oil return mechanism 18 that is provided in the oil filter base 21. The oil filter base 21 has a main configuration including a base block 23 that overlaps the wall surface 7*a* of the crankcase 7 from the outside and a filter base 24 that is integrally molded on the base block 23.

The base block 23 closes the opening portion 7*c* of the opening flow path 7*b*. The base block 23 overlaps the wall surface 7*a* of the crankcase 7 at a lower portion of the opening portion 7*c*. A fixation flange 27 that attaches the oil filter base 21 to the crankcase 7 is formed on the base block 23. An insertion hole 27*a* through which a bolt (not shown) is inserted is formed on the fixation flange 27.

The insertion hole 27*a* penetrates in a thickness direction of the fixation flange 27. By inserting the bolt through the insertion hole 27*a* and tightening the bolt to the base block 23, the oil filter base 21 is fastened and fixed to the crankcase 7.

Further, the oil return mechanism 18 is provided inside the base block 23. Details of the oil return mechanism 18 are described later.

The filter base 24 is formed in a circular plate shape. The filter base 24 includes a base surface 24*a* on which the oil filter 22 is placed. The filter base 24 is arranged such that a normal direction of the base surface 24*a* is oblique relative to the upward-downward direction. An outlet flow path 25 is formed at the middle in a radial direction of the base surface 24*a*. The outlet flow path 25 is in communication with the opening flow path 7*b*.

An inlet flow path 26 is formed on the base surface 24*a* around the outlet flow path 25. The inlet flow path 26 is in communication with the main gallery 19 on the upstream side of the oil filter 22. A communication hole 26*b* that is formed on an inner surface 26*a* of the inlet flow path 26 is in communication with the main gallery 19.

The oil reception flange 28 is integrally molded on an outer circumferential surface of the filter base 24. The oil reception flange 28 is provided on a lower half of the outer circumferential surface of the filter base 24. That is, the oil reception flange 28 is formed in a semicircular shape along the lower half of the filter base 24 when seen from the normal direction of the base surface 24*a*. An end surface 28*a* on the opposite side of the base surface 24*a* of the oil reception flange 28 is obliquely formed relative to the base surface 24*a* and is along a horizontal plane. The oil reception flange 28 covers a lower portion of the oil filter 22.

The oil filter 22 includes: a filter case 31 in a cylindrical shape having a bottom; and a filter main body 32 that is stored in the filter case 31. The filter case 31 is fixed to the base surface 24*a* such that an end surface 31*a* on an opening portion side of the filter case 31 is in contact with the base surface 24*a*. The filter main body 32 is arranged in an inner space that is closed by the filter case 31 and the base surface 24*a*.

A normal direction of the base surface 24*a* is oblique relative to the upward-downward direction. Therefore, the oil filter 22 that is arranged on the base surface 24*a* protrudes obliquely upward relative to the upward-downward direction from the base surface 24*a*. A lower half circumference of a circumferential edge portion of the oil filter 22 on the base surface 24*a* side is covered by the oil reception flange 28 that is provided below the lower half circumference.

In such a configuration, oil flows into the filter case 31 from a lower direction of the main gallery 19 via the inlet flow path 26 of the oil filter unit 17 (refer to an arrow Y2 in FIG. 2). Then, the oil is flows out to the outlet flow path 25 via the filter main body 32 (refer to an arrow Y3 in FIG. 2). Further, the oil flows into the opening flow path 7*b* via the outlet flow path 25 (refer to an arrow Y4 in FIG. 2), and the oil is delivered to the main gallery 19 toward the movable portion 8 (refer to an arrow Y5 in FIG. 2).

<Oil Return Mechanism>

The oil return mechanism 18 includes: an oil discharge port 33 that is formed on the wall surface 7*a* of the crankcase 7 at a position where the oil filter base 21 overlaps; an oil discharge flow path 34 that causes the oil discharge port 33 to be in communication with the opening flow path 7*b*; and a stopper mechanism 35 that is provided in the oil discharge flow path 34. The oil discharge port 33 causes the inside and the outside of the wall surface 7*a* of the crankcase 7 to be in communication with each other. The oil discharge flow path 34 includes: an upper introduction path 36 and a lower introduction path 37 that have one end which is in communication with the opening flow path 7*b*; a return flow path 38 that has one end which is in communication with the oil discharge port 33; and a discharge flow path main body 39 that causes the other end of each introduction path 36, 37 to be in communication with the other end of the return flow path 38.

The introduction paths 36, 37 and the return flow path 38 extend in the horizontal direction. The upper introduction path 36 is arranged at an upper section of the opening portion 7*c* of the opening flow path 7*b*. The lower introduction path 37 is arranged at a lower section of the opening portion 7*c* of the opening flow path 7*b*. The return flow path 38 is arranged below the lower introduction path 37. The flow path cross-sectional areas of the introduction paths 36, 37 and the return flow path 38 are approximately identical. An orifice 40 is provided on the other end (an end portion on the discharge flow path main body 39 side) of the lower introduction path 37. The flow path cross-sectional area of the orifice 40 is sufficiently smaller than the flow path cross-sectional area of the lower introduction path 37.

The discharge flow path main body 39 is formed by forming a recess portion toward an upward direction from a downward direction in the base block 23 and closing an opening portion 23*a* that is formed at a lower portion of the base block 23 by a plug 44. A seal portion 45 is provided between the base block 23 and the plug 44. A space between the base block 23 and the plug 44 is sealed by the seal portion 45. The seal portion 45 is, for example, a packing. Thereby, the discharge flow path main body 39 is formed to extend in the upward-downward direction in a region from the upper introduction path 36 to the return flow path 38.

The lower introduction path 37 is arranged at a further lower position than the middle in the upward-downward direction of the discharge flow path main body 39. The flow path cross-sectional area of the discharge flow path main body 39 is sufficiently larger than the flow path cross-sectional areas of the introduction paths 36, 37 and the return flow path 38. The stopper mechanism 35 is provided in the discharge flow path main body 39. An enlarged diameter portion 39*a* having an enlarged diameter through a step is formed on a lower portion of the discharge flow path main body 39.

A step portion 41 is formed on an upper portion of the discharge flow path main body 39. The step portion 41 is arranged on the opposite side of the opening flow path 7*b*. By the step portion 41, the flow path cross-sectional area of the upper portion of the discharge flow path main body 39 is slightly smaller than the flow path cross-sectional area of the rest of the discharge flow path main body 39. The step portion 41 restricts the movement of a stopper main body 42 (described later) of the stopper mechanism 35.

The stopper mechanism 35 includes: a stopper main body 42 in a cylindrical shape having a bottom that is provided to be slidable in the upward-downward direction on the discharge flow path main body 39; and a coil spring 43 that elastically biases the stopper main body 42 upward. The stopper main body 42 is formed in a cylindrical shape having a bottom. The stopper main body 42 is arranged such that an opening portion 42*a* faces downward (the plug 44 side). The outer diameter of the stopper main body 42 is approximately the same as or slightly smaller than the inner diameter of the discharge flow path main body 39.

Most of the upper portion of the coil spring 43 is stored in the stopper main body 42. The lower portion of the coil spring 43 is fitted to a fixation protrusion portion 44*a* that has a cylinder shape and is formed to protrude on the plug 44. Thereby, the positioning of the coil spring 43 is performed. The coil spring 43 is stored in a compressed state, and a biasing force toward an upward direction (an opposite side of the plug 44) acts on the stopper main body 42.

A bottom wall 42*b* of the stopper main body 42 that is pressed by the coil spring 43 hits against a step portion 41 of the discharge flow path main body 39. Therefore, even when the stopper main body 42 is located at the uppermost position, the space between the upper introduction path 36 and the discharge flow path main body 39 is not blocked by the stopper main body 42. Even when the stopper main body 42 is located at the uppermost position, an introduction space 39*b* that is in communication with the upper introduction path 36 is formed at an upper portion of the discharge flow path main body 39.

The length in an axis direction (the upward-downward direction) of the stopper main body 42 is a length in which the lower introduction path 37 (the orifice 40) is not closed by the stopper main body 42 in a state where the stopper main body 42 is located at the uppermost position. Further, the length in the axis direction of the stopper main body 42 is a length in which the lower introduction path 37 (the orifice 40) is closed by the stopper main body 42 in a state where the stopper main body 42 is located at the uppermost position (details will be described later).

<Operation of Oil Circulator Apparatus>

Next, an operation of the oil circulator apparatus 5 is described.

First, a case where the engine 4 is driven is described.

When the movable portion 8 of the engine 4 is driven, the oil pump 16 is driven through the crankshaft (not shown). Then, the oil in the oil flow path 15 is pumped up from a lower side to an upper side, and the oil is delivered to the movable portion 8 in the crankcase 7 (refer to the arrow Y1 in FIG. 1). At this time, the oil is filtered by the oil filter unit 17 that is provided in the middle of the main gallery 19 and is delivered to the movable portion 8.

That is, the oil that has passed through the oil filter unit 17 flows into the opening flow path 7*b* and is further delivered upward through the main gallery 19. At the same time, the oil that has flowed into the opening flow path 7*b* is guided to the upper introduction path 36 and the lower introduction path 37 of the oil filter unit 17 (refer to an arrow Y6 in FIG. 3).

Figure 4:
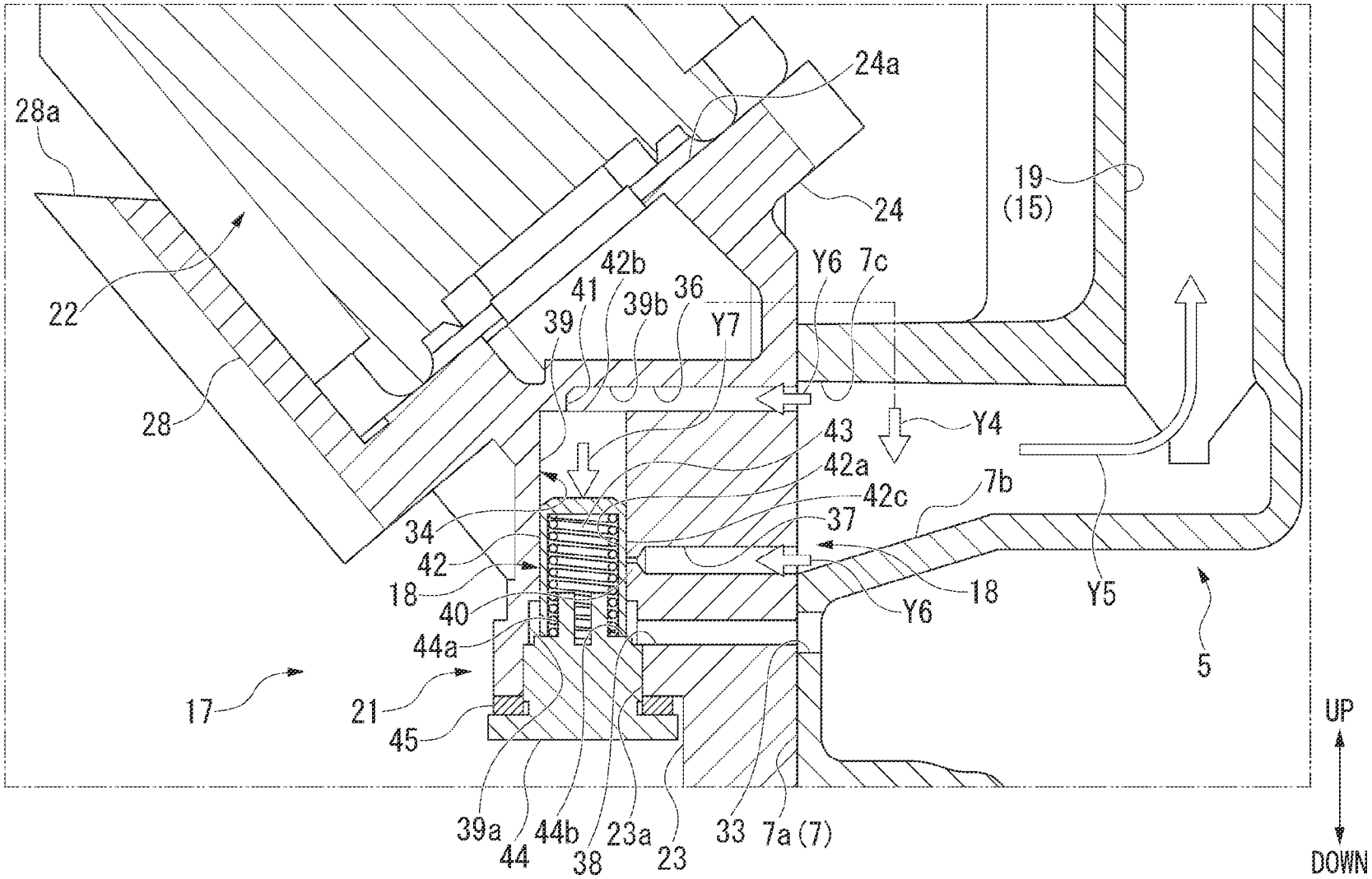
FIG. 4 is a view showing an operation of an oil return mechanism according to the embodiment of the present invention.

FIG. 4 is a view showing an operation of the oil return mechanism 18. FIG. 4 corresponds to FIG. 3 described above.

As shown in FIG. 4, the oil that is guided to the upper introduction path 36 further fills the introduction space 39*b* of the discharge flow path main body 39. Then, the pressure of the oil that is filled in the introduction space 39*b* acts on the bottom wall 42*b* of the stopper main body 42.

The oil that is guided to the lower introduction path 37 does not cause a significant pressure to act on the stopper main body 42 by the orifice 40. Further, even if some pressure of the oil acts on a circumferential wall 42*c* of the stopper main body 42, only a force toward the radial direction slightly acts. As a result, the stopper main body 42 slides downward against a spring force of the coil spring 43 (refer to an arrow Y7 in FIG. 4).

Then, an end portion on the opening portion 42*a* side of the stopper main body 42 hits against an upper surface 44*b* of the plug 44. The space between the return flow path 38 and the discharge flow path main body 39 is blocked by the stopper main body 42. Therefore, the oil that has passed through the oil filter unit 17 is delivered to the movable portion 8 without flowing into the return flow path 38.

Next, a case where the engine 4 is stopped is described.

When the movable portion 8 of the engine 4 is stopped, the oil pump 16 also stops. Then, the flow of the oil in the oil flow path 15 also stops. At a time point when the oil pump 16 is stopped, the oil remains (stays) at a further downstream side (hereinafter, referred to as a downstream side of the main gallery 19) than the oil filter unit 17 (the oil filter 22) of the main gallery 19. Therefore, the oil is guided from the opening flow path 7*b* to the upper introduction path 36 and the lower introduction path 37 of the oil filter unit 17 (refer to an arrow Y6 in FIG. 3). Further, the oil is also filled in the introduction space 39*b* of the discharge flow path main body 39.

The pressure of the oil that is filled in the introduction space 39*b* at this time is smaller than the pressure of the oil when the oil pump 16 is driven. Therefore, the stopper main body 42 does not slide downward. The stopper main body 42 keeps being located at an upper position by the pressing pressure of the coil spring 43. That is, the bottom wall 42*b* of the stopper main body 42 keeps hitting the step portion 41 of the discharge flow path main body 39.

In this state, the lower introduction path 37 is in communication with the discharge flow path main body 39 via the orifice 40. Further, the discharge flow path main body 39 is in communication with the return flow path 38. Therefore, oil flows into the discharge flow path main body 39 via the orifice 40. Further, oil is discharged into the crankcase 7 via the return flow path 38 and the oil discharge port 33 (refer to an arrow Y8 in FIG. 3). In this way, the oil discharge port 33 is formed at the downstream side of the main gallery 19.

When the engine 4 is stopped, by discharging the oil at the downstream side of the main gallery 19 from the oil discharge port 33, the oil does not remain at the downstream side of the main gallery 19. Therefore, for example, the overflow of oil at the time of maintenance of the oil filter 22 is prevented.

More specifically, for example, when the filter main body 32 of the oil filter 22 is maintained at the time of stopping of the engine 4, the filter case 31 is removed from the base surface 24*a* of the oil filter base 21. At this time, since the oil does not remain at the downstream side of the main gallery 19, the oil does not overflow even when the filter case 31 is removed.

Further, the lower half circumference of the circumferential edge portion of the oil filter 22 on the base surface 24*a* side is covered by the oil reception flange 28. Therefore, even if the oil slightly leaks, the oil can be received by the oil reception flange 28.

In this way, the oil circulator apparatus 5 described above includes the oil filter 22 that is provided in the middle of the main gallery 19 and the oil discharge port 33 that is provided at the downstream side of the main gallery 19. In this way, a structure is employed which causes the oil in the main gallery 19 to return into the crankcase 7 at the time of stopping of the engine 4. In order to cause the oil to return from the main gallery 19 into the crankcase 7, it is sufficient only to provide the oil discharge port 33. Therefore, it is not necessary to ensure an additional space, and it is also possible to simplify the structure of the oil circulator apparatus 5. Accordingly, the oil circulator apparatus 5 can be downsized, and it is possible to prevent the increase in manufacturing costs. When replacing the oil filter 22 (the filter main body 32), it is possible to effectively prevent the overflow of oil, and it is possible to contribute to the improvement of energy efficiency.

In order to provide the oil filter 22 in the middle of the main gallery 19, the oil filter unit 17 is provided on the wall surface 7*a* of the crankcase 7. The oil discharge flow path 34 that causes the downstream side (the opening flow path 7*b*) of the oil filter 22 to be in communication with the oil discharge port 33 is provided on the oil filter base 21 of the oil filter unit 17. Therefore, processing to the crankcase 7 side can be reduced as much as possible. It is sufficient to process the oil filter base 21 in order to prevent the overflow of oil when replacing the oil filter 22. Accordingly, the processing for causing the oil to return from the main gallery 19 into the crankcase 7 can be facilitated. Therefore, it is possible to prevent the increase in manufacturing costs of the oil circulator apparatus 5.

The orifice 40 is provided on the lower introduction path 37 of the oil discharge flow path 34. Therefore, it is possible to prevent the oil from returning from the oil discharge port 33 into the crankcase 7 via the oil discharge flow path 34 in vain at the time of driving of the movable portion 8. Therefore, it is possible to contribute to the improvement of energy efficiency.

The stopper mechanism 35 (the stopper main body 42) is provided on the discharge flow path main body 39 of the oil discharge flow path 34. By the stopper main body 42, the flow of the oil from the main gallery 19 to the oil discharge port 33 is permitted and blocked. Therefore, by the stopper main body 42, it is possible to further reliably prevent the oil from returning from the oil discharge port 33 into the crankcase 7 via the oil discharge flow path 34 in vain at the time of driving of the movable portion 8. Therefore, it is possible to further contribute to the improvement of energy efficiency.

In order to cause the stopper mechanism 35 to function, the oil discharge flow path 34 is constituted of the upper introduction path 36, the lower introduction path 37, the communicating return flow path 38, and the discharge flow path main body 39 that causes the introduction paths 36, 37 to be in communication with the return flow path 38. The stopper main body 42 is arranged between the upper introduction path 36 and the lower introduction path 37 and is arranged to be capable of closing the lower introduction path 37 and the oil discharge port 33 at the same time. The orifice 40 is provided on the lower introduction path 37. The stopper main body 42 is elastically biased toward the upper introduction path 36 by the coil spring 43 constantly. Therefore, the stopper main body 42 can reliably function with a simple structure. By the stopper main body 42, it is possible to reliably prevent the oil from returning from the oil discharge port 33 into the crankcase 7 via the oil discharge flow path 34 in vain at the time of driving of the movable portion 8. Therefore, it is possible to contribute to the improvement of energy efficiency.

The oil filter 22 protrudes obliquely upward relative to the main gallery 19. The lower portion of the oil filter 22 is covered by the oil reception flange 28. Therefore, for example, even if oil leaks at the time of replacement of the oil filter 22, it is possible to receive oil by the oil reception flange 28.

Modification Example

The present invention is not limited to the embodiment described above and includes various modifications to the embodiment described above without departing from the scope of the present invention.

The above embodiment is described using a case in which the oil return mechanism 18 includes the oil discharge port 33, the oil discharge flow path 34, and the stopper mechanism 35. However, the embodiment is not limited thereto, and the stopper mechanism 35 may not be provided. In this case, in the oil discharge flow path 34, the lower introduction path 37 may be in communication with the return flow path 38 without providing the upper introduction path 36.

In such a configuration, since the orifice 40 is provided in the lower introduction path 37, even when the movable portion 8 of the engine 4 is driven, the oil does not actively flows through the return flow path 38. Therefore, the oil that has passed through the oil filter unit 17 is delivered to the movable portion 8 without flowing into the return flow path 38.

On the other hand, when the movable portion 8 of the engine 4 is stopped, the flow of the oil in the oil flow path 15 is stopped. Therefore, the oil that is introduced to the lower introduction path 37 flows into the return flow path 38 via the orifice 40. Further, oil is discharged into the crankcase 7 via the oil discharge port 33.

Figure 5:
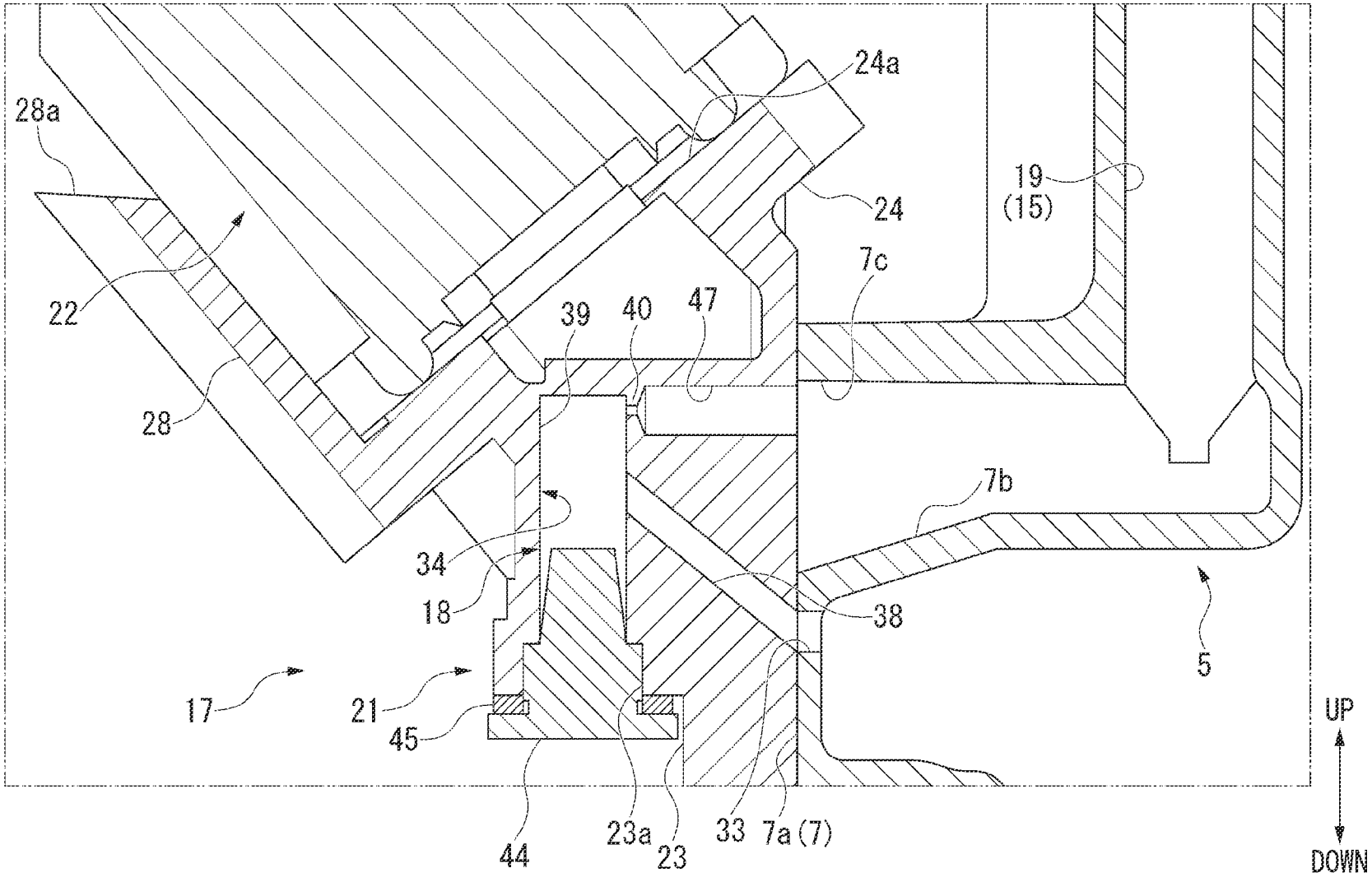
FIG. 5 is a cross-sectional view along the upward-downward direction of the oil return mechanism according to a modification example of the present invention.

FIG. 5 is a cross-sectional view along the upward-downward direction showing another modification example of the oil return mechanism 18 in which the stopper mechanism 35 is not provided. FIG. 5 corresponds to FIG. 3 described above.

As shown in FIG. 5, in the oil return mechanism 18 in which the stopper mechanism 35 is not provided, the oil discharge flow path 34 may be one introduction path 47 in place of the upper introduction path 36 and the lower introduction path 37. The introduction path 37 causes an upper section of the opening portion 7*c* of the opening flow path 7*b* to be in communication with an upper section of the discharge flow path main body 39. The orifice 40 is provided on another end (an end portion of the discharge flow path main body 39 side) of the introduction path 37.

The return flow path 38 is formed to be inclined in a downward gradient toward the oil discharge port 33 from a lower portion than the middle in the upward-downward direction of the discharge flow path main body 39. The flow path cross-sectional area of the return flow path is slightly smaller than the flow path cross-sectional area of the introduction path 37.

Even in such a configuration, effects similar to those of the embodiment described above is achieved. Further, since the number of the introduction path can be one compared to the embodiment (modification example) described above, the oil return mechanism 18 can be simplified. Further, since the return flow path 38 is formed to be inclined in a downward gradient toward the oil discharge port 33, when the movable portion 8 of the engine 4 is stopped, the oil does not remain in the oil return mechanism 18, and it is possible to cause the oil in the oil return mechanism 18 and the oil at the downstream side of the main gallery 19 to quickly return into the crankcase 7. In particular, even when the outboard engine 1 is tilted up, oil can be angled and return into the crankcase 7.

In the case of the modification example described above, the return flow path 38 may not be formed to be inclined. It is sufficient for the return flow path 38 to be formed in a downward gradient toward the oil discharge port 33. For example, the return flow path 38 may be formed to curve to a certain degree.

The above embodiment is described using a case in which the stopper mechanism 35 includes the stopper main body 42 and the coil spring 43 that elastically biases the stopper main body 42 upward. However, the embodiment is not limited thereto, and a member that can elastically bias the stopper main body 42 can be used in place of the coil spring 43. For example, a rubber can be employed in place of the coil spring 43.

The above embodiment is described using a case in which in order to provide the oil filter 22 in the middle of the main gallery 19, the oil filter base 21 that supports the oil filter 22 is provided. A case is described in which the oil discharge flow path 34 that causes a further downstream side of the main gallery 19 than the oil filter 22 to be in communication with the oil discharge port 33 is formed on the oil filter base 21. However, the embodiment is not limited thereto, and it is sufficient that the oil discharge port 33 is provided so as to cause a further downstream side of the main gallery 19 than the oil filter 22 to be in communication with the inside of the crankcase 7. The embodiment is not limited to a case in which the oil discharge port 33 is formed on a portion of the wall surface 7*a* of the crankcase 7 with which the oil filter base 21 overlaps.

When the oil discharge port 33 is provided directly so as to cause the further downstream side of the main gallery 19 than the oil filter 22 to be in communication with the inside of the crankcase 7, the oil discharge port 33 may be provided as follows. That is, when the movable portion 8 of the engine 4 is driven, the size of the flow path cross-sectional area of the oil discharge port 33 may be adjusted such that the oil is not discharged into the crankcase 7 via the oil discharge port 33.

DESCRIPTION OF REFERENCE NUMERALS

5 Oil circulator apparatus
7 Crankcase
8 Movable portion
15 Oil flow path
16 Oil pump
19 Main gallery
21 Oil filter base
22 Oil filter
28 Oil reception flange
32 Filter main body (oil filter)
33 Oil discharge port
34 Oil discharge flow path
35 Stopper mechanism
36 Upper introduction path (oil discharge flow path, second communication path)
37 Lower introduction path (oil discharge flow path, first communication path)
38 Return flow path (oil discharge flow path)
39 Discharge flow path main body (oil discharge flow path)
40 Orifice
42 Stopper main body (stopper)
43 Coil spring (elastic member)

What is claimed is:

1. An oil circulator apparatus comprising:
a crankcase in which a movable portion is stored;
an oil flow path that is provided on the crankcase and guides oil to the movable portion;
an oil pump that delivers the oil to the movable portion via the oil flow path;
a main gallery that is provided in a middle of the oil flow path and is formed along an upward-downward direction;
an oil filter that is provided in a middle of the main gallery and filters the oil which flows through the main gallery;
an oil discharge port that is provided in the main gallery at a further downstream side in a flow direction of the oil than the oil filter and causes the main gallery to be in communication with an inside of the crankcase; and
an oil filter base which is provided in a middle of the main gallery and to which the oil filter is attached,
wherein the oil filter base comprises:
an oil discharge flow path that causes the downstream side of the oil filter to be in communication with the oil discharge port;
an orifice that is provided on the oil discharge flow path and has a flow path cross-sectional area which is smaller than a flow path cross-sectional area of the oil discharge flow path; and
a base surface on which the oil filter is placed, and
the orifice is provided at a lower position than the base surface.

2. The oil circulator apparatus according to claim 1,
wherein the oil discharge flow path includes a return flow path that is connected to the oil discharge port, and
the return flow path is formed in a downward gradient toward the oil discharge port.

3. The oil circulator apparatus according to claim 1, comprising:
a stopper that is provided on the oil discharge flow path and permits and blocks a flow of the oil from the main gallery to the oil discharge port via the oil discharge flow path.

4. The oil circulator apparatus according to claim 3, comprising:
a first communication path and a second communication path that cause the oil discharge flow path to be in communication with the main gallery;

wherein the stopper is arranged between the first communication path and the second communication path and is arranged such that the first communication path and the oil discharge port are capable of being closed simultaneously, and the oil circulator apparatus comprises an elastic member that is provided on the oil discharge flow path and elastically biases the stopper from the first communication path and the oil discharge port toward the second communication path.

5. The oil circulator apparatus according to claim 1, wherein the oil filter is provided so as to protrude obliquely upward relative to the main gallery, and the oil circulator apparatus comprises an oil reception flange that covers a lower portion of the oil filter.

6. The oil circulator apparatus according to claim 5, wherein oil reception flange comprises: a portion along the oil filter; and an end surface that is oblique relative to the base surface and is along a horizontal plane.

7. The oil circulator apparatus according to claim 1, wherein the main gallery and the crankcase are constantly in communication with each other.

* * * * *